United States Patent [19]

Yaji et al.

[11] 4,349,052

[45] Sep. 14, 1982

[54] HEALD FRAME FOR LOOMS

[75] Inventors: Saichi Yaji, Izumisano; Kazuya Kitawaki, Osaka; Takafumi Furuya, Izumisano, all of Japan

[73] Assignee: Nankai Kogyo Kabushiki Kaisha, Osaka, Japan

[21] Appl. No.: 154,756

[22] Filed: May 30, 1980

[30] Foreign Application Priority Data

| | | | |
|---|---|---|---|
| Aug. 27, 1979 | [JP] | Japan | 54-117627 |
| Feb. 6, 1980 | [JP] | Japan | 55-14337 |
| Apr. 4, 1980 | [JP] | Japan | 55-45666 |

[51] Int. Cl.[3] ..... D03C 9/06

[52] U.S. Cl. ..... 139/92

[58] Field of Search ..... 139/82, 83, 91, 92

[56] References Cited

U.S. PATENT DOCUMENTS

| | | | |
|---|---|---|---|
| 3,335,759 | 8/1967 | Koch | 139/91 |
| 4,015,638 | 4/1977 | Graf | 139/91 |
| 4,015,639 | 4/1977 | Koch | 139/92 |
| 4,275,772 | 6/1981 | Shimizu | 139/91 |

FOREIGN PATENT DOCUMENTS

| | | | |
|---|---|---|---|
| 1131606 | 6/1962 | Fed. Rep. of Germany | 139/91 |
| 415836 | 11/1946 | Italy | 139/91 |
| 288681 | 1/1971 | U.S.S.R. | 139/91 |

*Primary Examiner*—Henry Jaudon

*Attorney, Agent, or Firm*—Browdy and Neimark

[57] ABSTRACT

A heald frame for looms comprises a frame structure and support members which support opposed lateral edges of the frame structure. The support members, together with vertically reciprocating drive units connected thereto, are installed in the loop. The frame structure is adapted to be removably attached to the support members, so that the frame structure can be simply attached to and detached from the loom. Intermediate stays are attached at suitable positions and extend between the upper and lower frame staves of the frame structure, while elastic members are disposed between the respective connecting portions of the frame staves and side stays of the frame structure.

6 Claims, 16 Drawing Figures

HEALD FRAME FOR LOOMS

FIELD OF THE INVENTION

The present invention relates to improvements in a heald frame (also referred to as heddle frame) attached to a loom for operating warp yarns. More particularly, the invention relates to a heald frame comprising a frame structure and support members which support opposed lateral edges of said frame structure, and means for effecting easy attachment and detachment between said frame structure and said support members, wherein said support members, together with vertically reciprocating drive units connected thereto, are permanently installed in the loom, while said frame structure is adapted to be removably attached to said support members.

BACKGROUND OF THE INVENTION

A conventional heald frame is designed so that it is directly attached to the loom and that connection of the vertically reciprocating drive units is made directly to the heald frame itself. Therefore, whenever the conventional heald frame is attached to or detached from the loom, its attachment to and detachment from the vertically reciprocating drive units must be effected, which is troublesome. Further, when the loom is operating at high speed, the heald frame is rapidly reciprocated up and down, producing deflections in the frame staves of the heald frame, which deflections, in turn, deform the heald frame to the extent of causing troubles to the operation on the warp yarns. Moreover, such deformation of the heald frame results in heavy loads acting on the respective connecting portions of the frame staves constituting the upper and lower sides of the frame and the side stays constituting the right and left sides of the frame, thus even fracturing the connecting portions.

SUMMARY OF THE INVENTION

An object of the invention is to provide a heald frame comprising a frame structure and support members which support opposed lateral edges of said frame structure, the arrangement being such that said frame structure is removably attached to said support members.

Another object of the invention is to provide a heald frame comprising support members which are permanently attached to the loom and which have heald frame-vertically reciprocating drive units attached thereto, and a frame structure adapted to be easily attached to and detached from said support members.

A further object of the invention is to provide a heald frame including intermediate stays extending between the upper and lower frame staves to minimize deflections produced in the frame staves during high speed operation.

Still a further object of the invention is to provide a heald frame including elastic members disposed between the respective connecting portions of the frame staves and the side stays so as to absorb loads which are produced on said connecting portions as the heald frame deforms.

DESCRIPTION OF THE PREFERRED EMBODIMENTS

Figure 1:
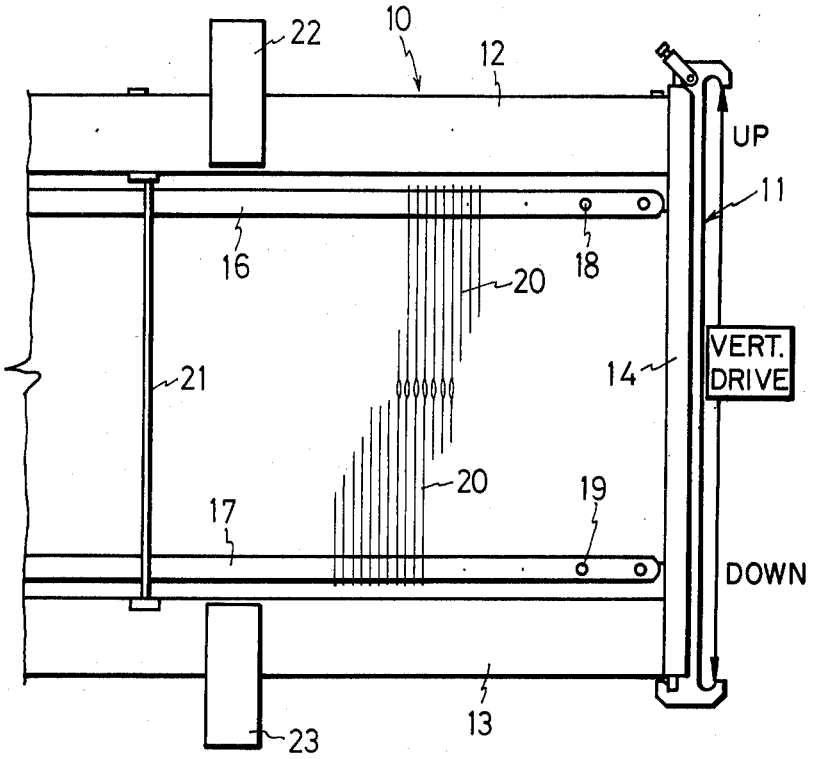
FIG. 1 is a front view of approximately the right half of a heald frame according to an embodiment of the present invention.

Embodiments of the invention will now be described with reference to the accompanying drawings. As shown in FIG. 1, a heald frame according to the invention comprises a frame structure 10 and support members 11. The frame structure 10 has its upper and lower sides constituted of frame staves 12 and 13 and its right and left sides constituted of side stays 14. In FIG. 1, approximately the left half of the heald frame is omitted from illustration but it has substantially the same construction as the illustrated right half. The upper and lower frame staves 12 and 13 have carrier rods 16 and 17 attached thereto, respectively. The upper and lower carrier rods 16 and 17 are fixed to the frame staves 12 and 13 by rivets 18 and 19, respectively, at suitable positions so that the carrier rods are substantially parallel to each other. The upper and lower carrier rods 16 and 17 support a number of healds 20 at their upper and lower ends. Intermediate stays 21 are disposed at suitable positions and extend between the upper and lower frame staves 12 and 13. The number of said intermediate stays 21 is not limited. Thus, the number may be singular or plural, depending upon the width of the heald frame. The upper and lower frame staves 12 and 13 have guide members 22 and 23 attached thereto at suitable positions.

Figure 2:
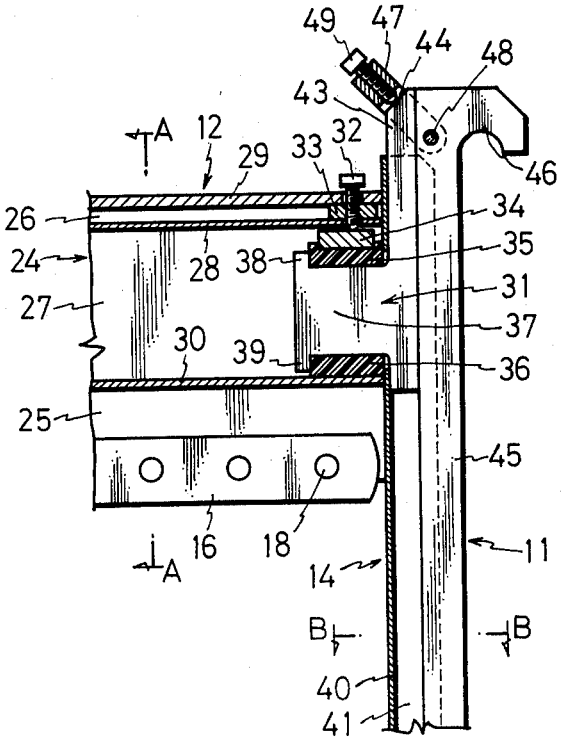
FIG. 2 is an enlarged section, showing an upper connecting portion in the embodiment shown in FIG. 1.
Figure 3:
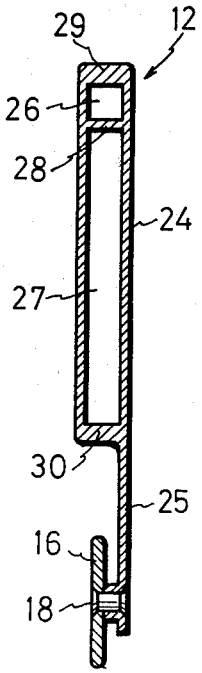
FIG. 3 is an enlarged section taken along the line A—A of FIG. 2.

The shape of the frame stave 12 is shown in detail in FIGS. 2 and 3. The frame stave 12 has an upper portion 24 of elongated, vertically extending hollow cross-section and a lower portion 25 in the form of a plate to which the carrier rod 16 is attached. The interior of the hollow upper portion 24 of the frame stave 12 is partitioned into two hollow portions 26 and 27 by a wall 28.

Inserted in the hollow portion 27 is a connecting member 31 fixed to the side stay 14, said connecting member 31 being fixed in position by a bolt 32. The bolt 32 is inserted from above and through the upper wall 29 of the frame stave 12 to extend through the hollow portion 26 until its front end reaches the hollow portion 27. A nut 33 is fitted in the hollow portion 26 for threaded reception of the bolt 32. Therefore, when the bolt 32 is turned in the tightening direction, the front end of the bolt downwardly presses a keep plate 34. An elastic member of rubber or synthetic resin is interposed between the keep plate 34 and the portion 37 of the connecting member 31 inserted in the hollow portion 27, and a second elastic member 36 is interposed between said portion 37 and the lower wall 30 of the hollow portion 27. Therefore, holding down the keep plate 34 by means of the bolt 32 will clamp the connecting member 31 between the elastic members 35 and 36 to fix it in position. The end of the insert portion 37 of the connecting member 31 is formed with projections 38 and 39 which engage the end surfaces of the elastic member 35 and 36, respectively. Therefore, the connecting member 31, when in the clamped state, will never slip off the hollow portion 27.

Figure 4:
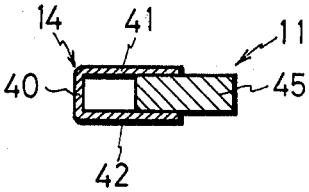
FIG. 4 is an enlarged section taken along the line B—B of FIG. 2.
Figure 5:
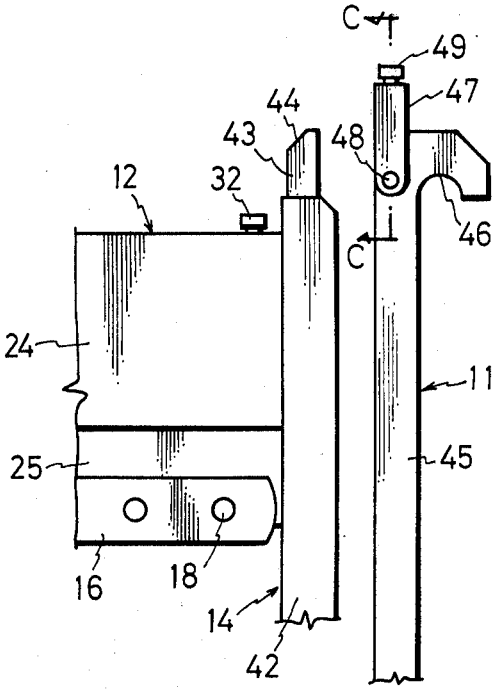
FIG. 5 is a view of a frame structure and a support member included in said embodiment, shown separated from each other.
Figure 6:
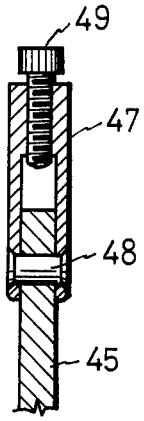
FIG. 6 is a section taken along the line C—C of FIG. 5.

The side stay 14, as shown in FIGS. 2 and 4, has a substantially U-shaped cross-section, with the connecting member 31 fixed thereto with its insert portion 37 projecting inwardly through the end wall 40 of the side stay 14 and with its bar portion 43 extending upwardly through the upper end of the side stay 14. The support member 11, in this embodiment, is composed of a side vertical rod 45 adapted to fit in a groove defined between the opposed lateral walls 41 and 42 of the side stay 14. The upper end of the side vertical rod 45 is formed with a hook 46 having a clamp 47 attached thereto. The clamp 47, as shown in FIGS. 2, 5 and 6, is pivotally connected to the side vertical rod 45 by a pin 48 and includes a bolt 49. Thus, when the bolt 49 is turned, its front end bears down onto the inclined portion 44 of the bar portion 43 of the connecting member 31.

Figure 7:
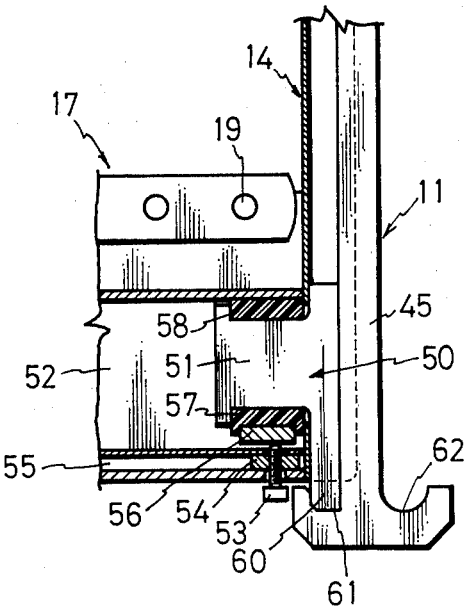
FIG. 7 is an enlarged section of a lower connecting portion included in said embodiment.
Figure 8:
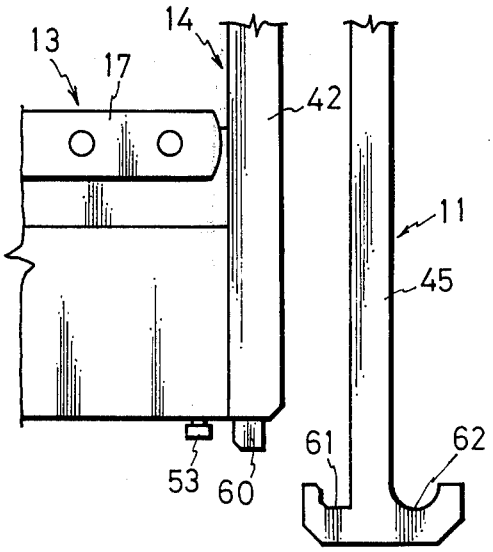
FIG. 8 is a view showing the frame structure and support member of FIG. 7 separated from each other.

The lower frame stave 13 has, as shown in FIGS. 7 and 8, substantially the same shape as the upper stave 12 but in inverted relation to the latter, and its means for connection to the side stay 14 is also substantially the same. Thus, the insert portion 51 of a connecting member 50 fixed to the side stay 14 is inserted in the hollow portion 52 of the frame stave 13 and is fixed in position by means of a bolt 53. The numeral 54 denotes a nut inserted in the hollow portion 55; 56 denotes a keep plate; and 57 and 58 denote elastic members. The difference from the upper section is that the bar portion 60 of the connecting member 50 extends downwardly through the lower end of the side stay 14. The projecting portion of the bar portion 60 fits in a groove 61 formed in the side vertical rod 45 on the inner side of the lower end thereof. The outer side of the lower end of the side vertical rod 45 is formed with a hook 62. A drive unit for vertically reciprocating the heald frame will be connected to said hook 62 and the hook 46 in the upper section. Accordingly, the support member 11 composed of the side vertical rod 45, when it has a vertically reciprocating drive unit connected thereto, is permanently installed in the loom. Thus, the heald frame structure 10 is attached to the support members 11 and is vertically reciprocated as the support members 11 are vertically reciprocated. Detachment of the heald frame structure 10 from the support members 11 may be effected simply by releasing the clamps 44 and upwardly pulling the frame structure 10, while the mounting of the frame structure 10 is effected in such a manner that, on either side of the heald frame, with the vertical rod 45 fitted in the grooves between the lateral walls 41 and 42 of the side stay, the frame structure 10 is lowered from above the support member 11 until the end of the bar portion 60 projecting beyond the lower end of the side stay fits in the groove 61 of the vertical rod 45, whereupon the inclined portion 44 of the bar portion 43 projecting beyond the upper end of the side stay 14 is held down by the front end of the bolt 49 of the clamp 47.

Figure 9:
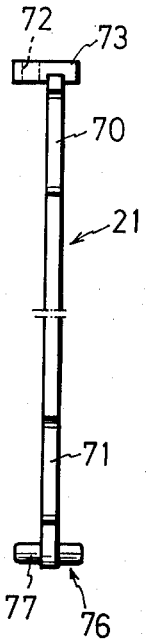
FIG. 9 is an enlarged front view of an intermediate stay included in the embodiment shown in FIG. 1.
Figure 10:
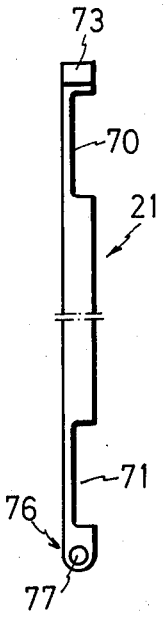
FIG. 10 is a side view of the intermediate stay of FIG. 9.
Figure 11:
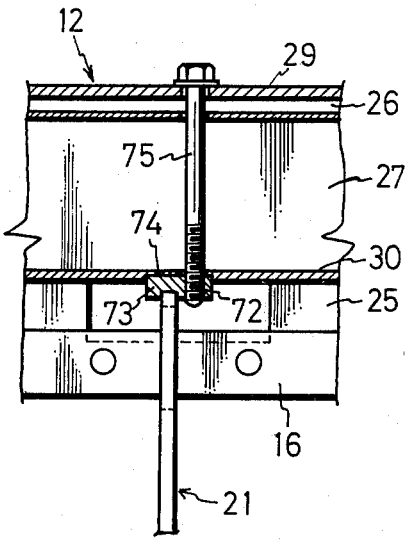
FIG. 11 is an enlarged section showing the upper attaching portion of the intermediate stay.
Figure 12:
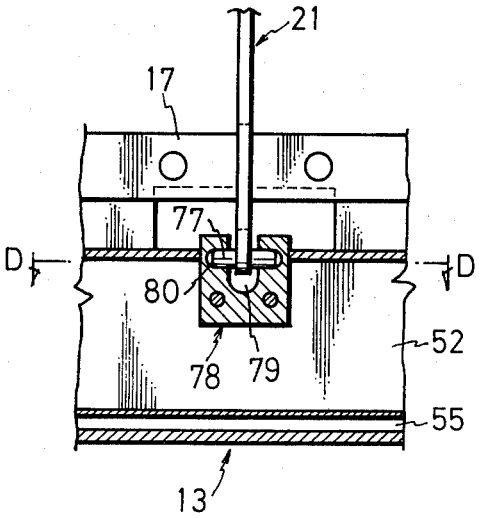
FIG. 12 is an enlarged section showing the lower attaching portion of the intermediate stay.
Figure 13:
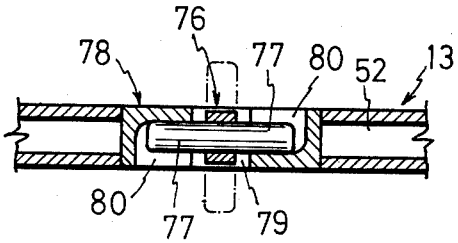
FIG. 13 is an enlarged section taken along the line D—D of FIG. 12.

As shown in FIGS. 9 and 10, the intermediate stay 21 is substantially in the form of a bar. The purpose of notches 70 and 71 formed in the intermediate stay 21 is to clear the carrier rods 16 and 17. Fixed to the upper end of the intermediate stay 21 is a fixing member 73 having a threaded hole 72. The fixing member 73 is fitted in a groove 74 formed in the lower wall 30 of the hollow portion of the frame stave 12 and is fixed in position by a bolt 75 extending through the hollow portion 24. The lower end of the intermediate stay 21 is formed with a hook 76 having a connector bar 77 extending therethrough and fixed therein such that equal lengths of said connector bar project to opposite sides of the intermediate stay 21. FIGS. 12 and 13 show how the hook 76 is connected. A hook fixing member 78 is fixed to the lower frame stave 13 and is formed with a hole 79 vertically downwardly extending from the upper surface thereof, said hole 79 opening to the front and back. The connector bar 77 of the intermediate stay is fitted in connector grooves 80 which are formed in the hook fixing member to extend at right angles to the hole 79. The connector grooves 80 are shaped to receive the connector bar 77 and disposed on opposite sides of the hole 79, with one connector groove opening to the front and the other to the back, as viewed in FIG. 13. Thus, the connection of the hook 76 to the hook fixing member 78 is effected by inserting the lower end of the intermediate stay 21 into the hole 79 in the fixing member 78 such that the connector bar 77 assumes the phantom line position shown in FIG. 13, and turning the intermediate stay 21 through 90 degrees so as to fit the connector bar 77 in the connector grooves 80. The attachment of the intermediate stay 21 to the heald frame is effected by connecting the hook 76 formed on the lower end of the intermediate stay 21 to the fixing member 78 on the lower frame stave 17, and then fixing the upper end of the intermediate stay 21 to the upper frame stave 12 by the bolt 75. The intermediate stay can be detached by performing the above operation in the reverse order.

Figure 14:
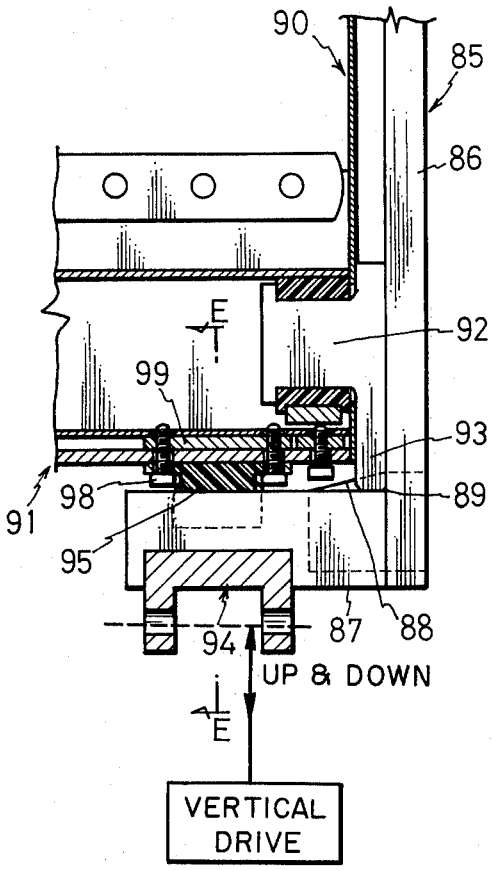
FIG. 14 is an enlarged section showing a lower connecting portion in a heald frame according to another embodiment of the invention.
Figure 15:
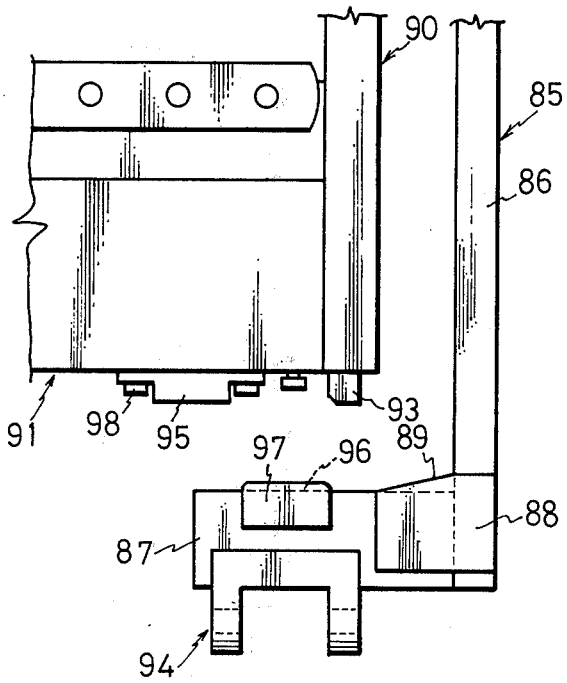
FIG. 15 is a view of a frame structure and a support member in the embodiment in FIG. 14, shown separated from each other.
Figure 16:
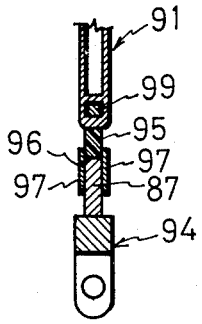
FIG. 16 is a section taken along the line E—E of FIG. 14.

FIGS. 14, 15 and 16 illustrate another embodiment of the invention. This embodiment is substantially the same as the preceding embodiment except for the method of connecting together the support member and the support members that receive a vertically reciprocating drive unit. Thus, the support member 85 in this embodiment has no hooks attached to the upper and lower ends thereof and instead the lower end of a side vertical rod 86 constituting the support member 85 has an inwardly directed plate 87 fixed thereto in the form of the letter L. A pair of reinforcing plates 88 are applied one to each side of the connection between the vertical rod 86 and the plate 87, said reinforcing plates projecting upwardly at the corner defined by the vertical rod 86 and plate 87, thus defining a triangular groove 89 at said corner. The side stay 90 and the lower frame stave 91 are connected together by using a connector member 92, as in the case of the preceding embodiment. The lower end of the bar portion 93 of the connector member 92 projects downwardly beyond the lower end of the side stay 90 and fits in the groove 89. The lower portion of the plate 87 has a joint member 94 fixed thereto for receiving the vertically reciprocating drive unit. In this embodiment, both an upward force and a downward force are applied through the joint member 94. This is contrasted with the preceding embodiment using upper and lower hooks to which upward and downward forces are separately applied. In this embodiment using a joint member, the vertically reciprocating drive unit employed is usually of the crank type, while the vertically reciprocating drive unit employed in the preceding embodiment using hooks is usually of the cam type.

In this embodiment, since both upward and downward forces are applied to the joint member 94, as described above, there is a danger of twist being produced in the plate 87. Accordingly, this embodiment is provided with means for avoiding such twist. More particularly, a connecting member 95 of plastic or metal is fixed to the lower surface of the frame stave 91, so that it will fit into a groove 96 formed at the upper end of the plate 87 when the heald frame structure is installed. The groove 96 is defined by attaching a pair of lateral wall members 97 to opposite surfaces of the plate 87 such that the upper ends of said lateral wall members project above the upper end of the plate 87. The numeral 98 denotes bolts for fixing the connecting member 95 in position, and 99 denotes nuts associated therewith. With this arrangement, when the heald frame structure is mounted on the support members 85, the connecting member 95 on each side fits in a groove 96, thus providing increased strength which resists the twisting of the plate 87, ensuring that even when upward and downward driving forces are applied to the joint member 94, there will be no twist produced in the plate 87.

It is to be understood that the description above is only illustrative of embodiments of the invention, that the scope of the invention is not limited to such embodiments and that various changes and modifications may be made without departing from the spirit and scope of the invention.

What is claimed is:

1. A heald frame for looms, comprising;

a heald frame structure comprising upper and lower frame staves and opposed lateral side stays connecting members interconnecting said upper and lower frame staves and said side stays, carrier rods attached to said upper and lower frame staves respectively, and a plurality of healds extending between said carrier rods, a pair of support members separate from said heald frame structure which support said side stays respectively and which are disposed on opposite sides of said heald frame, said heald frame structure including elastic members each disposed between the respective connecting members between said frame staves and said side stays, and one or more intermediate stays disposed at suitable positions and extending between said upper and lower frame staves, each of said side stays being formed at its upper and lower ends with connecting means for connecting said intermediate stays to said upper and lower frame staves, respectively, and said support members comprising means for supporting said upper and lower projections in said heald frame structure and means for interconnecting said support members to vertically reciprocating drive units.

2. A heald frame as set forth in claim 1, wherein said support members comprise vertical rods, said rods and said side stays of the heald frame structure being vertically slidably fitted together respectively, a lower projection on each side stay being fitted in a groove formed in the lower end of the associated vertical rod, and an upper projection on each side stay supported by clamp means attached to the upper end of the associated vertical rod.

3. A heald frame as set forth in claim 1, wherein the lower end of said intermediate stay is formed with a hook, the lower frame stave comprising a hook fixing member attached thereto, said hook and said hook fixing member being adapted to be fitted together, the upper end of said intermediate stay comprising a fixing member fixed thereto, and said fixing member being adapted to be fixed to the upper frame stave by bolts.

4. A heald frame as set forth in claim 1, a said connecting member being fixed to each side stay, with an insert portion of each said connecting member projecting through the side stay and being inserted into the hollow portion of the frame stave at one end, and said elastic members being applied to the upper and lower surfaces of said insert portion, each juncture of a said connecting member, a said frame stave and a said side stay being connected together by a bolt screwed into the frame stave, and the front ends of said bolts pressing against said insert portions through said elastic members.

5. A heald frame as set forth in claim 1, wherein the upper and lower ends of each support member are each formed with a hook, and said vertically reciprocating drive unit of the cam type is connected to said hooks.

6. A heald frame as set forth in claim 1, wherein the lower end of each support member has a joint member attached thereto, and said vertically reciprocating drive unit is of the crank type connected to said joint member.

* * * * *